US005479377A

United States Patent [19]

Lum et al.

[11] Patent Number: 5,479,377

[45] Date of Patent: Dec. 26, 1995

[54] MEMBRANE-SUPPORTED ELECTRONICS FOR A HYDROPHONE

[76] Inventors: Paul Lum, 690 Templebar Way, Los Altos, Calif. 94022; Michael Greenstein, 860 Covington Rd., Los Altos, Calif. 94024; Belinda Kendle, 21746 Noonan Ct., Cupertino, Calif. 95014

[21] Appl. No.: 359,156

[22] Filed: Dec. 19, 1994

[51] Int. Cl.[6] ..... H04R 17/00

[52] U.S. Cl. ..... 367/163; 367/174; 367/140; 310/324; 29/25.35

[58] Field of Search ..... 367/163, 180, 367/174, 140, 912; 310/324, 800; 29/25.35, 594

[56] References Cited

U.S. PATENT DOCUMENTS

| | | | |
|---|---|---|---|
| Re. 33,618 | 6/1995 | Harnden, Jr. et al. | 29/25.35 |
| 4,354,132 | 10/1982 | Borburgh et al. | 310/334 |
| 4,433,400 | 2/1984 | DeReggi et al. | 367/163 |
| 4,517,665 | 5/1985 | Dereggi et al. | 367/163 |
| 4,545,553 | 10/1985 | Finke et al. | 244/134 D |
| 4,571,579 | 2/1986 | Woolley | 340/566 |
| 4,597,099 | 6/1986 | Sawafuji | 381/90 |
| 4,638,468 | 1/1987 | Francis | 367/153 |
| 4,653,036 | 3/1987 | Harris et al. | 367/170 |
| 4,654,554 | 3/1987 | Kishi | 381/158 |
| 4,734,611 | 3/1988 | Granz | 310/324 |
| 4,782,469 | 11/1988 | Granz et al. | 367/157 |
| 5,035,247 | 7/1991 | Heimann | 128/715 |
| 5,055,838 | 10/1991 | Wise et al. | 340/870.37 |
| 5,339,290 | 8/1994 | Greenstein | 367/163 |
| 5,381,386 | 1/1995 | Lum et al. | 367/163 |

OTHER PUBLICATIONS

Author Unknown, "Phonocardiograph Microphone is Rugged and Moisture Proof", Notes from Manned Spacecraft Center, Houston, Tex.

Bacon, David R., "Characteristics of a pvdf Membrane Hydrophone for Use in the Range 1–100 MHz," *IEEE Transactions on Sonics and Ultrasonics,* vol. SU–29, No. 1, Jan. 1982, pp. 18–25.

DeReggi, A. S. et al., "Piezoelectric polymer probe for ultrasonic applications," *J. Acoust. Soc. Am.,* vol. 69 No. 3, Mar. 1981, pp. 853–859.

Lewin, Peter A. et al., "Integrated Preamplifiers for Ultrasound Transducers," *1985 Ultrasonics Symposium,* 0090–9607/85/0000–0503, 1985, pp. 503–506.

Preston, R. C. et al., "PVDF membrane hydrophone performance properties and their relevance to the measurement of the acoustic output of medical ultrasonic equipment," *J. Phys. E: Sci. Instrum.,* vol. 16, 1983, pp. 786–796.

*Primary Examiner*—Charles T. Jordan
*Assistant Examiner*—Christopher K. Montgomery

[57] ABSTRACT

A transducer device and method include affixing a preamplifier or other suitable circuit to a thin piezoelectric membrane. The membrane fully supports the circuit at an inactive region of the membrane. The membrane has at least one piezoelectrically active region that is connected to the circuit by a signal line. Preferably, the signal line is fabricated onto the membrane using integrated circuit fabrication techniques. In the preferred embodiment, the piezoelectrically active region has a diameter of less than one hundred microns and the membrane has a thickness of less than ten microns. A potting compound provides structural support of the membrane and insulates the on-membrane circuit.

18 Claims, 4 Drawing Sheets

MEMBRANE-SUPPORTED ELECTRONICS FOR A HYDROPHONE

TECHNICAL FIELD

The invention relates generally to piezoelectric membranes and more particularly to positioning circuitry for processing electrical signals to and from a piezoelectrically active region of a membrane.

BACKGROUND ART

Ultrasonic devices may be used in a wide variety of applications. For example, a hydrophone is a type of acoustic pressure sensor for calibrating an ultrasonic transducer of the type used in medical diagnosis and therapy. Calibration of the ultrasonic transducer can be achieved by directing waves from the transducer to the hydrophone. The hydrophone is operated to provide a quantitative assessment of the characteristics of the ultrasonic field that is created by the transducer in a liquid, such as water.

One type of hydrophone is referred to as a membrane hydrophone, which typically includes a thin film that is held in a taut condition by a rigid hoop. U.S. Pat. No. 4,653,036 to Harris et al. describes a membrane hydrophone having a circular sheet of polyvinylidene fluoride (PVDF) having a thickness of approximately 25 μm. At the center of the PVDF sheet is a piezoelectrically active spot. A fine diameter wire is connected to the active spot at one end and is connected to a coaxial connector at the other end. The coaxial connector is fixed to the hoop that supports the sheet. Electrical signals to and from the active spot pass through the coaxial connector and an attached cable for processing by external electronics.

It is known in the industry that the diameter of the active spot affects the performance of the hydrophone. A decrease in spot size produces some desired effects, but increases the electrical impedance of the hydrophone. The thickness of the membrane also affects performance. Reducing the thickness increases the maximum frequency of the hydrophone. However, the reduction in thickness renders the hydrophone more susceptible to damage, particularly during manufacture.

The advantage of including a preamplifier has been recognized. U.S. Pat. No. 5,035,247 to Heimann describes a preamplifier that is connected to a piezoelectric sensor by a short cable. The preamplifier has an output connected to a processor unit by a longer cable. Preamplification is also described by DeReggi et al. in U.S. Pat. No. 4,433,400 and in "Piezoelectric Polymer Probe for Ultrasonic Applications," *J. Acoust. Soc. Am.*, Vol. 69, No. 3, March 1981, pages 853–859. DeReggi et al. teach that the preamplifier may be mechanically attached at the inside diameter of the hoop that supports the piezoelectric membrane. The hoop-supported preamplifier is electrically connected by conductive epoxy material to a metallization on the membrane. The metallization extends from the preamplifier to an electrode on the active spot of the hydrophone. From the preamplifier, connection is made to a coaxial connector or the like.

A conventional membrane hydrophone typically has a diameter of approximately 100 mm. Reducing the diameter of the hydrophone may increase perturbations created by the hydrophone. On the other hand, reducing the diameter places the hoop-supported preamplifier closer to the active region, increasing the effectiveness of the preamplifier. U.S. Pat. No. 5,339,290 to Greenstein, which is assigned to the assignee of the present invention, describes a membrane hydrophone having an outer membrane supporting an interior transducer membrane that includes the piezoelectrically active region of the hydrophone. The structure of the outer membrane can be selected based upon achieving mechanical characteristics, while the structure of the transducer membrane can be selected to maximize acoustic and electrical characteristics. Greenstein cites polyimide as an acceptable material for forming the outer suspension membrane. Because it is selected for its mechanical properties, Greenstein teaches that a preamplifier may be formed on the outer suspension membrane. Thus, the preamplifier is brought closer to the active region.

While the dual-membrane hydrophone device of Greenstein decreases the signal loss by placing the amplifier closer to the active region, it does so at the expense of increasing the complexity of manufacture. However, the rationale within the transducer industry is that sacrifices related to manufacturing complexity or sacrifices related to signal loss must be made in order to achieve goals such as increasing the maximum frequency.

What is needed is an acoustic device, such as a hydrophone, and a method of forming the acoustic device such that performance is enhanced without substantial increases in manufacturing complexity.

SUMMARY OF THE INVENTION

The invention provides an acoustic device in which an electronic circuit, such as a preamplifier, is fully mechanically supported by a piezoelectric membrane. In the preferred embodiment, the piezoelectric membrane has a thickness of less than ten microns and has a poled piezoelectrically active region with a diameter of less than 100 microns. Within these dimensions, the acoustic device may be used in high frequency, high performance applications.

The piezoelectric membrane is secured in a taut condition and includes signal lines printed along at least one surface of the membrane. The signal lines may be formed using integrated circuit fabrication techniques. Also formed on the surface of the membrane is an electrode that is aligned with the piezoelectrically active region. An input/output signal extends from the electrode to an inactive region. The electronic circuit is electrically connected to the input/output signal line from the electrode. Electrical connection between the circuit and the signal line may be formed by a conductive epoxy.

Because the circuit is bonded directly to the membrane at the inactive region, circuitry for providing amplification and impedance matching can be positioned proximate to the active region. In the preferred embodiment, the circuitry is less than 25.4 mm from the active region, thereby reducing signal loss from the small diameter active region to an acceptable level.

While the circuit may be fabricated directly onto the membrane, the preferred embodiment is one in which a previously fabricated preamplifier is bonded onto the surface of the membrane.

The acoustic device is formed by patterning a metallic layer on a membrane surface to define the signal lines. Optionally, signal lines may be formed on both major surfaces of the membrane. A selected region of the membrane is then poled to align ferroelectric dipoles, thereby providing the active region for converting energy between an electrical signal and an acoustic signal. Discrete and integrated components are electrically and structurally bonded directly to the membrane. A potting material is then utilized to protect the on-membrane circuitry and to increase the structural stability of the transducer device.

An advantage of the invention is that the on-membrane circuitry permits a conventionally sized hydrophone to have an active region with a diameter of less than 100 μm. The positioning of on-membrane circuitry with respect to the active region permits amplification prior to attenuation that might otherwise render a generated signal insufficiently reliable. Another advantage is that because the diameter of the active region can be reduced to less than 100 μm, and preferably to less than 50 μm, the transducer device is usable for intravascular applications.

BEST MODE FOR CARRYING OUT THE INVENTION

Figure 1:
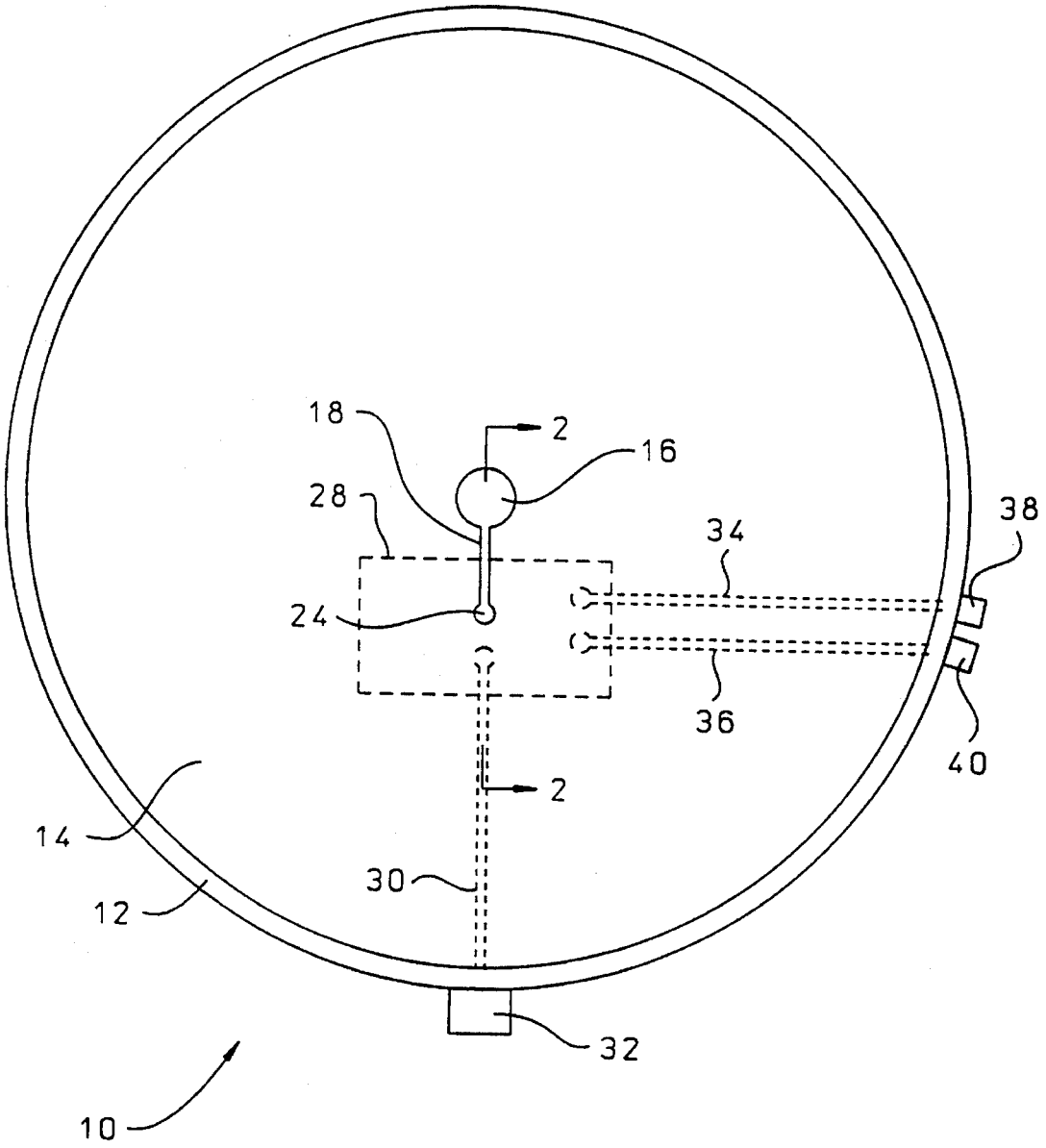
FIG. 1 is a top view of a transducer device in accordance with the invention.
Figure 2:
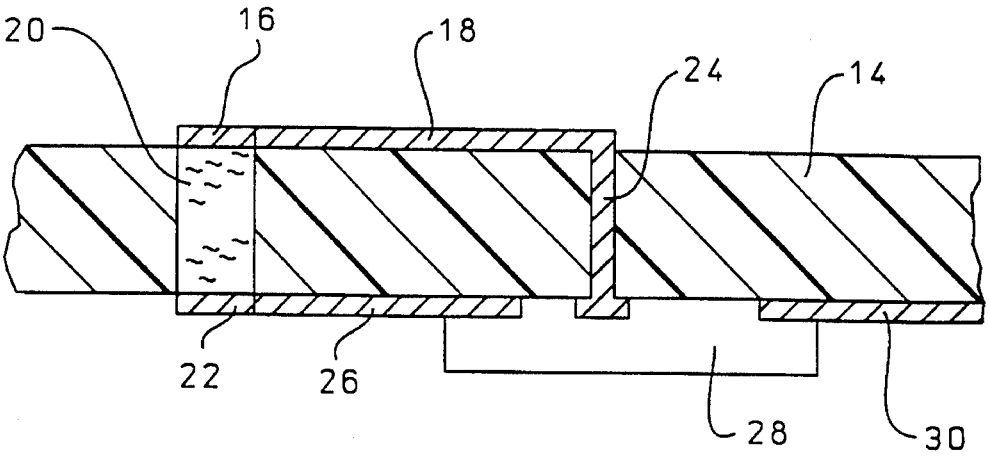
FIG. 2 is a side sectional view of a portion of the transducer device of FIG. 1, taken along lines 2—2.

With reference to FIGS. 1 and 2, a transducer membrane 10 is shown as including a hoop structure 12 that supports an annular transducer membrane 14. The transducer membrane is formed of a piezoelectric material and is held in a taut condition by the hoop structure. This may be accomplished by a compressive force at the outside diameter of the membrane.

In the preferred embodiment, the transducer device 10 is a hydrophone. An acceptable material for forming the membrane 14 is polyvinylidene fluoride (PVDF), but the PVDF copolymer polyvinylidene fluoride trifluoroethylene (PVDF-TrFE) is preferred. The copolymer is preferred because of its flexibility with regard to a poling process for aligning ferroelectric dipoles of the piezoelectric material. However, PVDF-TrFE is a fragile material when reduced to the dimensions to be described below.

At a center of the membrane 14 is an electrode 16. The electrode is circular and has dimensions that correspond with a piezoelectrically active region 20, shown in FIG. 2. A combination of heat and electrical bias is used to align the ferroelectric dipoles of the active region 20. After the dipoles have been generally aligned, the temperature is reduced to maintain the alignment. The active region 20 is then capable of efficient conversion of electrical energy to acoustic energy and conversion of acoustic energy to electrical energy.

At the bottom of the active region 20 is a second electrode 22, which may be part of a ground plane. The electrodes 16 and 22 are used to apply signals across the active region 20 and to receive electrical energy generated at the active region.

A first signal line 18 extends from the top electrode 16 to a via 24 through the membrane 14. The bottom electrode 22 is connected to a second signal line 26. Both the via 24 and the second signal line 26 are joined to a surface mountable device 28 having circuitry for processing electrical signals. In the preferred embodiment, the surface mountable device includes a preamplifier for amplifying signals and achieving an impedance match with external circuitry. Optionally, the surface mountable preamplifier may be replaced with a circuit that is formed directly onto the membrane 14 using integrated circuit fabrication techniques. Techniques for forming the signal lines 18 and 26 and the electrodes 16 and 22 will be described more fully below.

An output line 30 extends from the surface mountable preamplifier 28 to a region for connection to a signal connector 32. A cable, such as a 50 ohm cable, may be attached to the signal connector 32 for channeling signals to external processing equipment, not shown.

Figure 3:
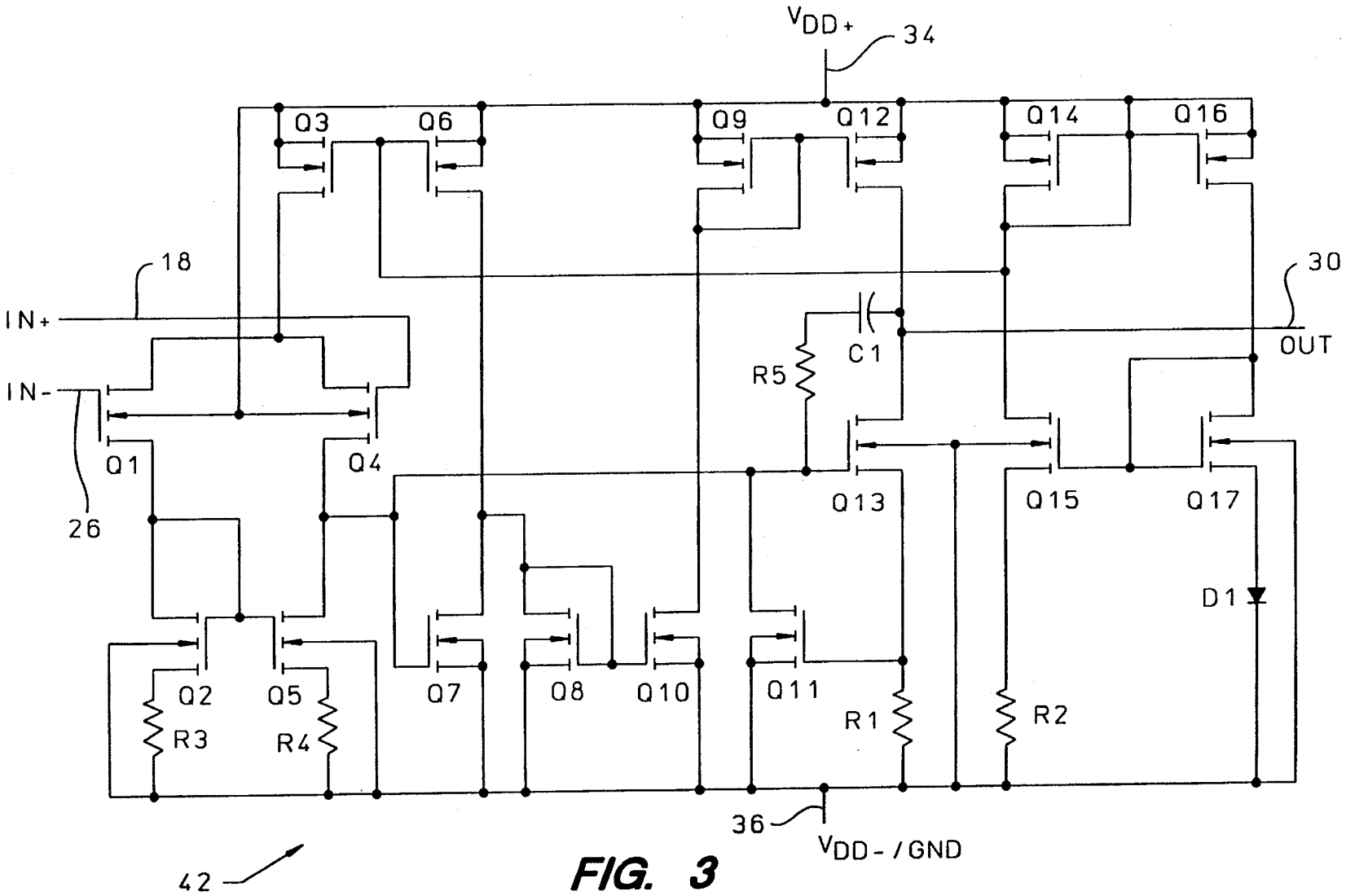
FIG. 3 is an electrical schematic of a preamplifier for use with the transducer device of FIG. 1.

Also shown in FIG. 1 are power lines 34 and 36 that attach to DC power plugs 38 and 40. In FIG. 3, a preamplifier circuit 42 is shown as including the first and second signal lines 18 and 26, the output line 30, and the two power lines 34 and 36. A preamplifier circuit is obtainable from Analog Devices under the part number AD9630. Such a circuit is a low distortion, 750 MHz wideband close loop buffer amplifier having a high impedance input and a low impedance output. While not shown, the power lines 34 and 36 should be decoupled to a ground trace or a ground plane. Decoupling may be achieved by use of 0.1 pf surface mounted capacitors.

Because the surface mountable device 28 of FIGS. 1 and 2 is mounted directly onto the membrane 14, the transducer device 10 may be formed with a greater emphasis on transducer performance and less emphasis on mechanical stability, as compared to prior art transducer devices. In the preferred embodiment, the thickness of the membrane 14 is less than 10 μm. For example, a high frequency hydrophone may be formed using a membrane 14 having a thickness of 4 μm and having a membrane-supported preamplifier 28. The diameter of the active region may be less than 100 μm, and is preferably less than 50 μm. The preamplifier 28 should be less than 25.4 mm from the active region 20, so that the signal loss from the small-diameter region of the thin membrane falls within an acceptable level.

Figure 4:
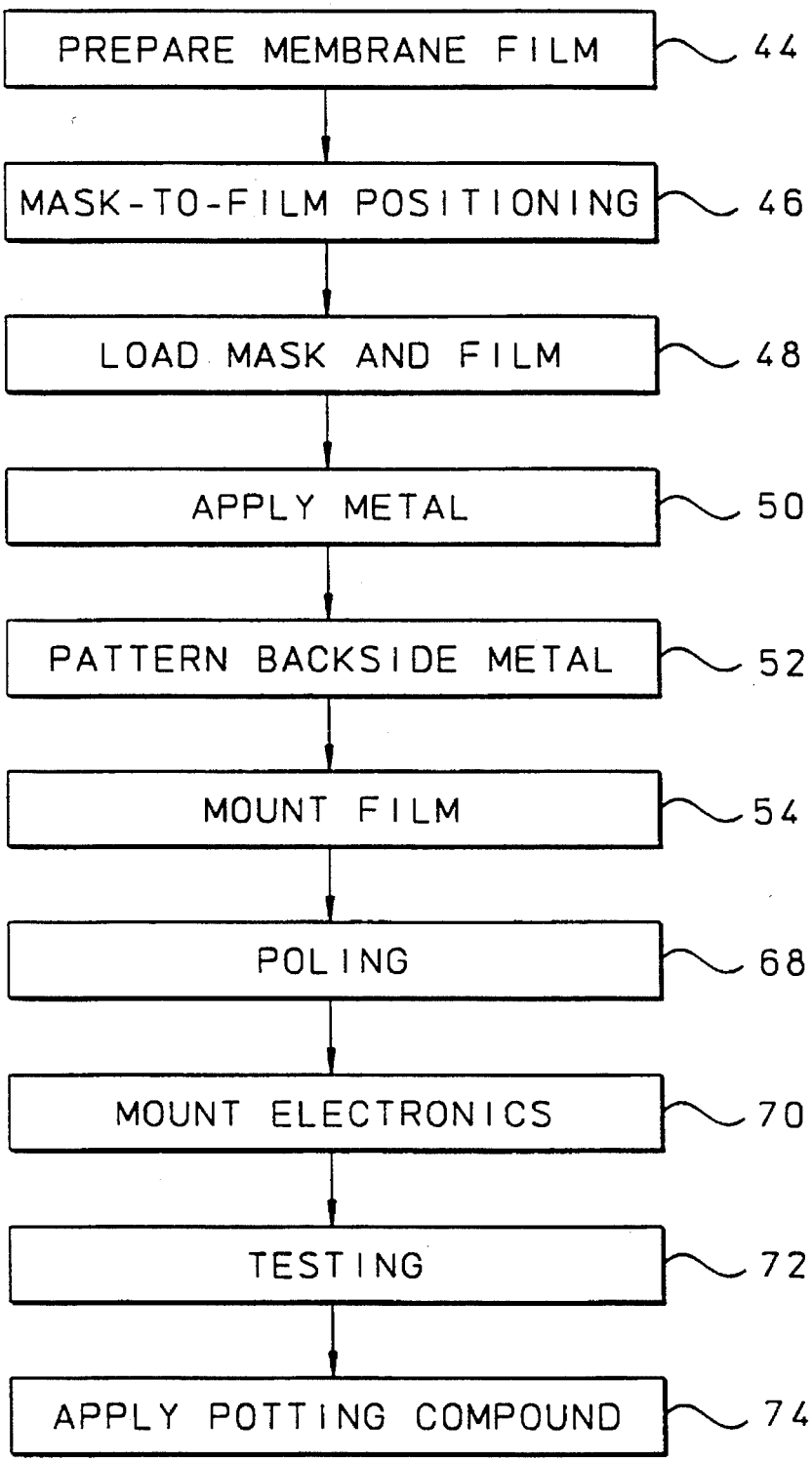
FIG. 4 is a flow chart of process steps for fabricating the transducer device of FIG. 1.

A fabrication procedure for forming the transducer device 10 is set forth in FIG. 4. In a first step, the membrane film 44 is prepared for subsequent processing. The preparation is designed to facilitate adhering thin metal films to the piezoelectric material.

Preferably, the membrane film is cut to the desired size and shape prior to cleaning. In practice, the film may be cut slightly oversize.

If PVDF is the membrane material, most oil-free solvents can be used to clean the film without concern for polymer degradation. However, if PVDF-TrFE is used, caution must be exercised in selecting a cleaning solution. PVDF-TrFE is susceptible to certain solvents, such as Acetone. A strong detergent or soap solution can be used to remove grease or oil compounds from the membrane film. The film should then be allowed to dry thoroughly. Air drying for several hours at room temperature is preferred. If a solvent such as n-propanol is used, a 30-minute wait is required prior to loading the membrane into a metal deposition system. The 30 minutes is approximately the time required for fixing the membrane to a hoop ring, so that no time is lost in the waiting period.

The step 44 of preparing the membrane film includes wiping the surfaces several times with cleanroom wipes and the selected cleaning fluid or fluids. Grease and oil marks should be completely removed. Likewise, any hair, dirt or metal filings should be removed. Preferably, the film surface is inspected under a microscope having a magnification of greater than 20×, so as to ensure cleanliness.

A metal pattern is then formed on at least one surface of the membrane film. The method of creating the metal pattern is not critical. In one embodiment, thermal evaporation using a negative pattern mask is utilized. Alternatively, plasma sputtering with a negative pattern mask may be employed. As a third alternative, metal may be lithographically patterned with resist lift-off and thermal evaporation techniques. Additional methods are also possible.

The preferred method is the one based upon thermal evaporation with a negative mask. Lithographically forming the pattern may cause difficulties and instabilities for PVDF and PVDF-TrFE films as thin as 4 μm. Regarding the plasma sputtering alternative, there are also difficulties with this selection. For example, a high deposition power may cause the membrane film to be degraded during deposition. On the other hand, thermal evaporation using a negative pattern mask is the least complex and most straightforward of the methods.

The thermal evaporation process using a negative pattern mask employs a temporary fixture to suspend the masked membrane pattern above thermal sources. The fixture may be a flat plate having a depression cut into the plate to allow the pattern mask to rest flush against a surface of the membrane film. A large magnet is placed beneath the membrane on the opposite side of the temporary fixture, so as to magnetically attract and hold the metal mask pattern flush against the membrane surface. Optionally, clamps may be used to ensure that the mask is flush against the membrane surface.

The proper positioning 46 of the mask relative to the membrane film is important to ensuring that the dimensions of signal lines and a poled region remain within acceptable tolerances. Linewidth control becomes more troublesome as the linewidth becomes equal to or less than the thickness of the selected shadow mask. "Negative shadow mask" is defined herein as a mask in which metal is deposited on the membrane surface in correspondence to openings in the metal mask. Thus, by design, the metal mask is a negative pattern of the desired metal pattern.

A number of types of masks have been developed for the electrodeposition technique. Preferably, the mask contains a pattern for both signal lines and for an electrode to be formed on the film.

Referring to FIG. 1, a pattern on an upper surface of the membrane 14 would include electrode 16 and the first signal line 18. On the lower surface, the mask would include openings corresponding to the lines 30, 34 and 36, as well as openings for the lower electrode and a signal line from the lower electrode. The lower surface typically will also include a ground plane.

The masking procedure prior to metal deposition requires that both the membrane film and the pattern mask be blown clean with deionized nitrogen. Preferably, the film and the mask are microscopically inspected. Magnifications ranging between 50× and 20× are recommended, with both transmission and back lighting. The membrane film should be installed on the magnetic fixture and a frame should be placed along the borders of the membrane film to hold the membrane taut against the deposition fixture plate.

The membrane and masking fixture are then loaded into a metal deposition system. This step 48 is shown in FIG. 4. Optionally, deionized nitrogen may be again applied to the mask and the membrane film, whereafter the vacuum chamber is closed.

At least one metal film is then applied 50. For example, titanium and gold may be deposited to desired thicknesses at the proper vacuum pressures. Alternatively, chrome and gold may be deposited. Acceptable metal thicknesses are 300 angstroms of titanium or chrome and 700 to 3000 angstroms of gold, deposited at 10E-6 Torr. A typical deposition rate for titanium or for chrome is 1.5 angstroms per second, while a typical deposition rate for gold is 5.5 angstroms per second.

In practice, fabrication of a hydrophone requires depositing metal on both sides of the membrane film. Thus, the above procedure is repeated at step 52 in order to pattern metal on the opposed side.

In step 54, the membrane film is mounted to a hoop ring in a manner known in the art. The membrane is stretched taut. Ideally, the membrane surface is planar and all wrinkles are eliminated. However, non planarity and wrinkles can be tolerated to some extent, other than at the central active region and at the signal lines formed on the film. Once the membrane film is stretched taut onto the hoop ring, loosening and retightening may cause irreversible damage to the membrane material.

Figure 5:
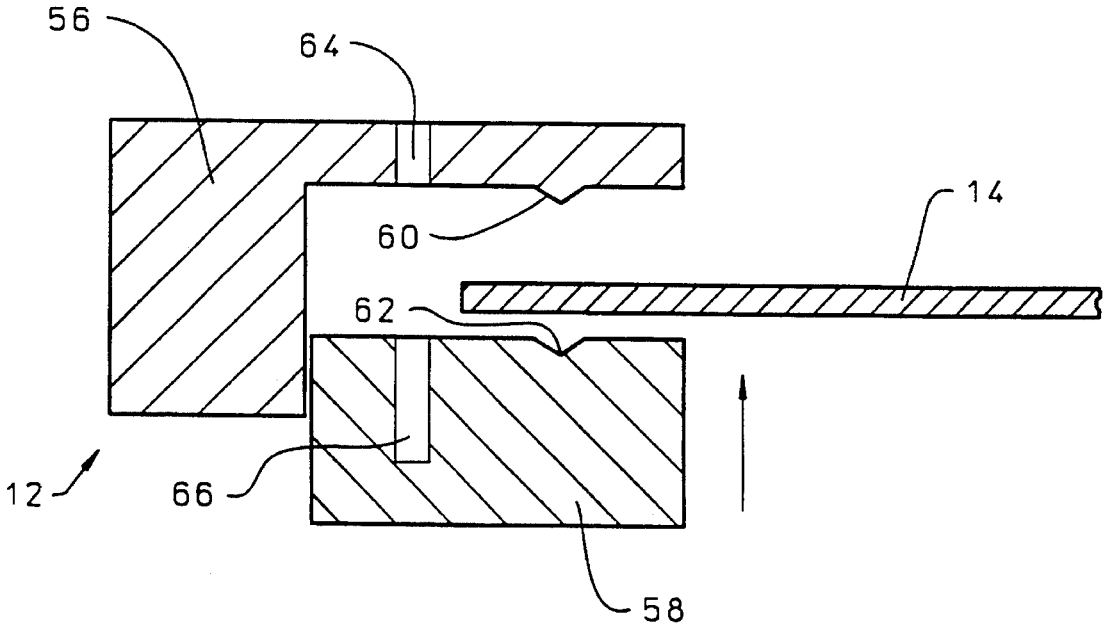
FIG. 5 is a side sectional view of a hoop structure for maintaining the membrane of FIG. 1 in a taut condition.

Referring now to FIGS. 1 and 5 the hoop structure 12 for securing the membrane film 14 in a planar wrinkle-free manner is shown as including an upper member 56 and a lower member 58. The upper member includes a wedge tooth 60 that is received within a groove 62 of the lower member. The wedge tooth-and-groove arrangement is designed to provide a friction locking grip on the membrane 14. The arrangement applies a sufficient material displacement for stretching the piezoelectric membrane film and for locking the membrane film in place. Fastening screws, not shown, may then be inserted through bores 64 in the upper member for tightening into internally threaded openings 66 in the lower member. The hoop structure 12 includes a number of bores of the type shown in FIG. 5. Preferably, a screw-tightening sequence is followed to minimize wrinkling of the membrane 14. The sequence typically followed is an "across-the-ring" pattern, rotating in a clockwise or counterclockwise direction.

A small bead of vacuum-grade epoxy may be applied to the groove 62 of the lower member 58 to allow the membrane 14 to ensure permanent locking of the membrane after the hoop structure has been fastened together. If such an epoxy is used, it is important to allow the epoxy time to properly dry and cure. Typically, a 24-hour drying and curing period is sufficient. During the application of epoxy, the small bead of epoxy placed in the ring groove 62 should be a minimal quantity, so as to prevent the epoxy from being pressed inwardly from the inside diameter of the hoop structure 12. If excess material does extend inside the inside diameter, the excess material should be removed. For example, a small amount of n-propanol may be used to remove the excess epoxy.

Returning to FIG. 4, the next step 68 in the fabrication procedure is to pole the active region of the piezoelectric membrane film 14. That is, the active region 20 between the electrodes 16 and 22 of FIG. 2 is subjected to a procedure in which ferroelectric domains of the material are aligned. Beyond the active region is a piezoelectrically inactive region in which the domains are generally random in direction. Procedures for poling PVDF and PVDF-TrFE are different. Only the poling procedure for PVDF-TrFE will be explained herein, but persons skilled in the art will readily understand the necessary procedure for poling PVDF.

In the preferred embodiment, the lower electrode 22 may actually be a part of a ground plane. PVDF films are often uniaxially or biaxially stretched and annealed to improve the mechanical and/or electrical properties of the film, converting the material properties from one crystalline form to another. However, it has been found that PVDF-TrFE need only be heated during the poling process to obtain the desired conversion. The poling is performed in a vacuum chamber to allow the poling to take place at voltages greater than those obtained in atmosphere. The vacuum chamber may be an NRC thermal evaporation system with a capability of pumping down to 10E-7 Torr. Such a system contains a fixture that is heated by two halogen quartz lamps with the ability to heat in the temperature range from 20° to more than 200° centigrade. The fixture contains a raised platform which allows an electrode to be both heated and grounded at the back side of the membrane film. A high voltage electrode clip on the top side of the membrane allows the placement of a high voltage potential on the previously deposited top electrode 16.

The poling procedure can begin by setting a high voltage power supply to 100 volts and setting the quartz heating lamp controller to 100° centigrade. When the temperature gauge indicates that the actual temperature of a grounding chuck is between 90° and 100° centigrade, the vacuum system is sealed. The vacuum pressure should be increased to 10E-6 Torr before the high voltage power supply setting is increased beyond 100 volts.

The quartz heating lamp controller should then be increased to approximately 130° centigrade. It should be noted that the PVDF-TrFE material breaks down and either adheres to or melts on the grounding chuck between the temperatures 136° and 140° centigrade. This processing problem is usually noted by a rapid linear rise in the high voltage power supply current. If this occurs, the material damage is irreversible and the process should be halted.

When the temperature gauge indicates that the grounding chuck is stabilized at 130° C., the high voltage can be gradually increased in increments of 10 volts or less per minute. The optimal voltage can be calculated by multiplying the thickness of the membrane film in micron units times 70 volts per micron. For example, a film having a thickness of 10 microns will require an optimal poling voltage of 700 volts. The slow and gradual increase in the high voltage aids in the avoidance of a sudden transient rise in the temperature potential across the membrane film. A rise that is too rapid potentially results in a dielectric breakdown or a permanent short across the membrane film.

After the high voltage power supply has been set to the calculated optimal voltage based upon the membrane thickness, the temperature and high voltage values should be maintained for a period of approximately one hour. The voltage is then maintained while the grounding chuck is rapidly cooled. This may be performed by turning the quartz heating lamps "off" and cooling the grounding chuck with water. When the temperature gauge indicates that the grounding chuck is 20° centigrade, both the high voltage power supply and the flow of cooling water can be turned "off." The vacuum system is then vented to atmosphere. Care should be taken when removing the membrane film from the poling fixture, since temperature annealing causes thin PVDF-TrFE films to become somewhat more brittle.

While the patterning of metallization on the surfaces of the membrane film has been described as steps of forming signal lines, optionally integrated circuit fabrication techniques can be used to fabricate a preamplifier and/or other electrical circuits. However, in the preferred embodiment, on-membrane electronics are adhesively secured to the membrane film.

As previously noted, the circuit of FIG. 3 is a buffer amplifier sold by Analog Devices. Referring to FIG. 1, the surface mountable amplifier 28 has an input (pin 4) at the via 24 and an output (pin 8) that is connected to the output trace 30 extending to the signal connector 32. Power contacts (pins 1 and 5) are attached to the power lines 34 and 36 that extend to the power plugs 38 and 40. Each of the power connections to the amplifier should be decoupled to a ground trace or ground plane with a 0.1 pf surface mounted capacitor, not shown. If ground traces from decoupling capacitors are on a side of the membrane 14 opposite to a ground plane, connection to the ground plane may be made by vias to the membrane. Membrane vias are formed by using a needle (30 gauge or 10 smaller) to puncture the membrane at ground pads. A small quantity of silver epoxy is then pressed through the via to form the interconnection to a ground plane on the opposite side. The silver epoxy should completely fill the via. Care must be taken so as not to rip the membrane during the formation of vias. Alternatively, vias may be formed by dry plasma etching or UV-laser ablation.

Silver epoxy is also used to connect the amplifier, capacitors and any wiring to the patterned metal on the opposed sides of the membrane 14. The silver epoxy will cure at room temperature over a period of between 12 and 24 hours.

In the preferred embodiment, the membrane 14 is positioned with the ungrounded electrode 16 at the top, but this is not critical. The hoop structure 12 of a membrane hydrophone should include predrilled and countersunk holes to allow attachment of the signal connector 32. The center conductor of the signal connector may be bent or trimmed in a manner to allow the conductor to gently touch the output trace 30. Preferably, the output trace includes a large metallized spot that facilitates connecting the center conductor of the connector 32 to the output trace. Small quantities of silver epoxy are used to electrically attach the center conductor and the ground leads of the signal connector to the appropriate areas of the membrane 14.

After the silver epoxy has been allowed to properly cure, the transducer device 10 is visually and electrically tested. A test step 72 of FIG. 4 may include a continuity check of all electrical connections, an impedance and resonance test to verify metal structure and poling integrity, and/or waveform and water tank testing to quantitatively and qualitatively determine the operational limits of the device.

In the next step 74, a potting compound is applied to the transducer device 10 for both structural support of the entire device and insulation of the on-membrane electronics 28. The structural support is important to a long useful-life of the thin membrane device. The potting reduces the susceptibility of the membrane 14 to ruptures.

The potting compound must be selected for its acoustic impedance. Preferably, the acoustic impedance is close to the acoustic impedance of the medium into which the device is to be operated. For example, a membrane hydrophone to be used in water should have a potting compound with an acoustic impedance close to that of water. An acceptable compound is sold by Dow Corning under the trademark SYLGARD 182, 184 or 186. Such a compound has the desired acoustic impedance, but will not distort the membrane film or incoming acoustic pressure waveforms. SYLGARD 182, SYLGARD 184 and SYLGARD 186 are each two-part compounds. A first part is a base and a second part is a curing agent. The base and curing agent are thoroughly mixed in a 10:1 weight ratio. The total amount used is based upon the amount of area to be coated or covered. Typically, a 5 mm thickness in the acoustic field and a 1 mm thickness over the on-membrane electronics 28 is suitable.

After the two components of the potting compound have been measured by weight and thoroughly mixed, the mixture is subjected to a 30-minute degassing under vacuum, with a maximum pressure of 2×10E-2 Torr. The final solution observed under vacuum should be clear and should have no visible bubbles. The potting mixture is then poured directly into the cavity of the transducer device containing the electrode and on-membrane electronics. There should be a minimum agitation or stirring of the compound mixture in order to avoid introduction of bubbles into the mixture. If bubbles are observed, degassing of the entire transducer device should take place under the vacuum parameters set forth above.

The transducer device and applied potting material are then cured for approximately seven to ten days at room temperature. The potting material becomes hard and loses its tackiness. Heating of the compound material should be avoided, since heating may introduce distortions to the membrane.

As a final step, the transducer device is again tested and evaluated.

We claim:

1. A transducer device comprising:

a piezoelectric membrane having a piezoelectrically active region and an inactive region, said active region having an alignment of dipoles for converting energy between an electrical signal and an acoustic signal, said membrane having a first planar surface;

a signal line extending along said first planar surface from said active region to said inactive region; and an electronic circuit fully mechanically supported by said membrane, said electronic circuit being mounted to said membrane and being electrically connected to said signal line for processing electrical signals generated at said active region.

2. The device of claim 1 wherein said signal line is a patterned metal layer on said membrane.

3. The device of claim 1 wherein said electronic circuit is a preamplifier.

4. The device of claim 1 wherein said electronic circuit is an integrated circuit fixed to said membrane.

5. The device of claim 1 wherein said membrane is formed of a copolymer of polyvinylidene fluoride.

6. The device of claim 5 wherein said membrane has a thickness less than 10 μm.

7. The device of claim 1 wherein said active region has a diameter of less than 50 μm.

8. The device of claim 1 wherein said electronic circuit is bonded to said first planar surface of said membrane.

9. The device of claim 1 further comprising potting material insulating said electronic circuit from a surrounding environment.

10. A hydrophone comprising:

a piezoelectric membrane having a poled active region and a piezoelectrically inactive region, said piezoelectric membrane having opposed major surfaces and a thickness perpendicular to said major surfaces, said thickness being less than 10 μm, said poled active region having a diameter of less than 100 μm;

a plurality of interconnect lines fabricated on at least a first surface of said major surfaces, including a first interconnect line extending from said poled active region to said piezoelectrically inactive region; and a signal processing circuit supported by one of said major surfaces, said circuit being fixed to said membrane at said piezoelectrically inactive region and being electrically connected to said first interconnect line.

11. The hydrophone of claim 10 further comprising a support frame, said piezoelectric membrane being secured to said support frame such that said piezoelectric membrane remains in a taut condition, said circuit being mechanically isolated from said support frame other than via connection to said piezoelectric membrane.

12. The hydrophone of claim 10 wherein said circuit is a preamplifier.

13. The hydrophone of claim 10 wherein said circuit includes a plurality of input/output pads electrically connected to said interconnect lines.

14. The hydrophone of claim 10 wherein said interconnect lines are a pattern of metal formed on said piezoelectric membrane.

15. A method of forming a transducer device comprising:

forming a piezoelectric membrane, including patterning a metallic layer on said membrane to form at least a first signal line extending along a planar surface of said membrane and further including poling a first region of said membrane to align magnetic dipoles within said first region, said poling being localized such that said poling leaves a piezoelectrically inactive region of said membrane; and fixing a signal processing electronic circuit to a surface of said membrane such that said circuit is supported by said membrane, including positioning said circuit to electrically connect to said first signal line, said first signal line extending from said piezoelectrically inactive region to said first region of said membrane.

16. The method of claim 15 wherein fixing said circuit includes bonding said circuit to said membrane.

17. The method of claim 15 wherein patterning said metallic layer includes forming an electrode at said first region.

18. The method of claim 15 further comprising potting said electronic circuit.

* * * * *